US009340914B2

(12) United States Patent
Manifold et al.

(10) Patent No.: US 9,340,914 B2
(45) Date of Patent: May 17, 2016

(54) FIBROUS STRUCTURES AND METHODS FOR MAKING SAME

(71) Applicant: The Procter & Gamble Company, Cincinnati, OH (US)

(72) Inventors: John Allen Manifold, Sunman, IN (US); Douglas Jay Barkey, Hamilton Township, OH (US); Angela Marie Leimbach, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 717 days.

(21) Appl. No.: 13/688,267

(22) Filed: Nov. 29, 2012

(65) Prior Publication Data

US 2013/0143001 A1 Jun. 6, 2013

Related U.S. Application Data

(60) Provisional application No. 61/566,292, filed on Dec. 2, 2011.

(51) Int. Cl.

| | |
|---|---|
| ***B32B 3/00*** | (2006.01) |
| ***D06C 23/04*** | (2006.01) |
| ***D21H 27/00*** | (2006.01) |
| ***D21H 27/02*** | (2006.01) |

(52) U.S. Cl.
CPC ..... *D06C 23/04* (2013.01); *D21H 27/002* (2013.01); *D21H 27/02* (2013.01); *Y10T 428/2457* (2015.01)

(58) Field of Classification Search
CPC ... D21H 27/002; D21H 27/02; D21H 27/004; D06C 23/04; Y10T 428/2457
USPC ..... 428/156, 167, 141
See application file for complete search history.

(56) References Cited

U.S. PATENT DOCUMENTS

| | | | | |
|---|---|---|---|---|
| 9,011,641 | B2 * | 4/2015 | Mohammadi et al. | 162/111 |
| 2006/0286885 | A1 | 12/2006 | Schuh et al. | |
| 2010/0297400 | A1 | 11/2010 | Mellin et al. | |
| 2011/0114277 | A1 | 5/2011 | Spitzer et al. | |
| 2013/0017370 | A1 * | 1/2013 | Yamaguchi et al. | 428/167 |

FOREIGN PATENT DOCUMENTS

WO WO 2011122355 A1 * 10/2011

OTHER PUBLICATIONS

International Search Report Mailed Feb. 15, 2013.

* cited by examiner

*Primary Examiner* — Catherine A Simone
(74) *Attorney, Agent, or Firm* — C. Brant Cook

(57) ABSTRACT

Fibrous structures and more particularly to fibrous structures that have a surface containing a surface pattern having a plurality of parallel line elements, such as sinusoidal parallel line elements, and methods for making same are provided.

20 Claims, 9 Drawing Sheets

FIBROUS STRUCTURES AND METHODS FOR MAKING SAME

FIELD OF THE INVENTION

The present invention relates to fibrous structures and more particularly to fibrous structures that comprise a surface comprising a surface pattern having a plurality of parallel line elements, such as sinusoidal parallel line elements, and methods for making same.

BACKGROUND OF THE INVENTION

Fibrous structures such as fibrous structures that comprise a surface comprising a surface pattern having a plurality of parallel line elements are known in the art. For example, embossed and/or wet textured fibrous structures, such as sanitary tissue products, comprising a surface comprising a surface pattern comprising parallel line elements are known in the art. For example, FIG. 1 illustrates a known wet textured bath tissue's surface pattern 10, where the parallel line elements 12 exhibit a constant width W along their length L. FIGS. 2A and 2B illustrate a known wet textured facial tissue's surface pattern 10 where the parallel line elements 12 exhibit a constant width W along their length L. FIG. 3 illustrates a known embossed bath tissue's surface pattern 10 where the parallel line elements 12 exhibit a constant width W along their length L.

Consumers of fibrous structures, such as sanitary tissue products, for example bath tissue, facial tissue, and paper towels continue to desire improved properties, such as softness, strength and/or cleaning perception.

Accordingly, there is a need for a fibrous structure surface pattern that provides fibrous structures with improved properties over known fibrous structures.

SUMMARY OF THE INVENTION

The present invention fulfills the need described above by providing a fibrous structure with a surface comprising a surface pattern having a plurality of parallel line elements, such as a plurality of sinusoidal parallel line elements.

In one example of the present invention, a fibrous structure comprising a surface comprising a surface pattern, wherein the surface pattern comprises a plurality of parallel line elements, wherein at least one parallel line element exhibits a non-constant width along its length, is provided.

In another example of the present invention, a fibrous structure comprising a first zone and a second zone, wherein the first zone exhibits a first CD stress/strain slope and the second zone exhibits a second CD stress/strain slope such that the difference between the greater of the first and second CD stress/strain slopes and the lesser of the first and second CD stress/strain slopes is greater than 1.1 as measured according to the Tensile Strength and Elongation Test Method described herein, is provided.

In still another example of the present invention, a fibrous structure comprising a first zone and a second zone, wherein the first zone exhibits a first CD stress/strain slope and the second zone exhibits a second CD stress/strain slope such that the ratio of the greater of the first and second CD stress/strain slopes to the lesser of the first and second CD stress/strain slopes is greater than 1.07 as measured according to the Tensile Strength and Elongation Test Method described herein, is provided.

In even another example of the present invention, a fibrous structure comprising a first zone and a second zone, wherein the first zone exhibits a first CD Modulus and the second zone exhibits a second CD Modulus such that the difference between the greater of the first and second CD Modulii and the lesser of the first and second CD Modulii is greater than 150 as measured according to the Tensile Strength Test Method described herein, is provided.

In yet another example of the present invention, a fibrous structure comprising a first zone and a second zone, wherein the first zone exhibits a first CD Modulus and the second zone exhibits a second CD Modulus such that the ratio of the greater of the first and second CD Modulii to the lesser of the first and second CD Modulii is greater than 1.15 as measured according to the Tensile Strength Test Method described herein, is provided.

In another example of the present invention, a sanitary tissue product comprising a fibrous structure according to the present invention is provided.

In still another example of the present invention, a method for making a fibrous structure according to the present invention is provided.

In one example, fibrous structures of the present invention comprise a uniform, cloud-like billowing macro-texture, which translates into an improved softness and cleaning perception for consumers.

DETAILED DESCRIPTION OF THE INVENTION

Definitions

Figure 1:
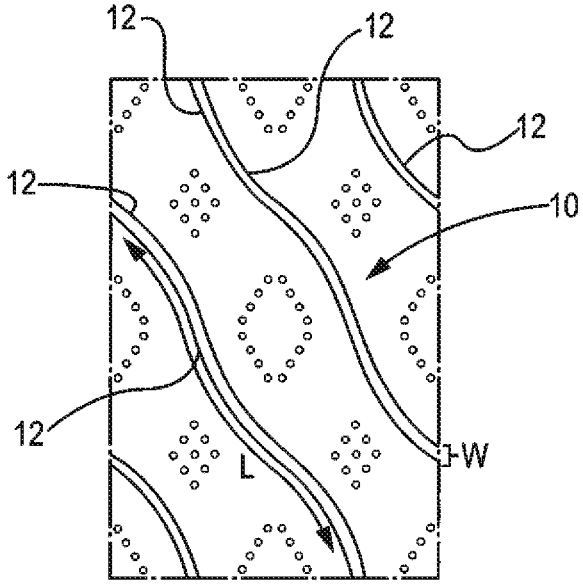
Fig. 1 PRIOR ART
FIG. 1 is a top plan view of a prior art surface pattern of a fibrous structure.

"Fibrous structure" as used herein means a structure that comprises one or more filaments and/or fibers. In one example, a fibrous structure according to the present invention means an orderly arrangement of filaments and/or fibers within a structure in order to perform a function. Non-limiting examples of fibrous structures of the present invention include paper, fabrics (including woven, knitted, and non-woven), and absorbent pads (for example for diapers or feminine hygiene products).

Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structures of the present invention may be homogeneous or may be layered. If layered, the fibrous structures may comprise at least two and/or at least three and/or at least four and/or at least five layers.

In one example, the fibrous structure of the present invention consists essentially of fibers, for example pulp fibers, such as cellulosic pulp fibers.

In another example, the fibrous structure of the present invention comprises fibers and is void of filaments.

In another example, the fibrous structure of the present invention comprises filaments and is void of fibers.

In still another example, the fibrous structures of the present invention comprises filaments and fibers, such as a co-formed fibrous structure.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers and synthetic staple fibers such as polyester fibers.

Filaments are typically considered continuous or substantially continuous in nature. Filaments are relatively longer than fibers. Non-limiting examples of filaments include melt-blown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking In addition to the various wood pulp fibers, other cellulosic fibers such as cotton linters, rayon, lyocell, trichomes, seed hairs, and bagasse can be used in this invention. Other sources of cellulose in the form of fibers or capable of being spun into fibers include grasses and grain sources.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products and/or fibrous structures of the present invention may exhibit a basis weight of greater than 15 g/m$^2$ (9.2 lbs/3000 ft$^2$) to about 120 g/m$^2$ (73.8 lbs/3000 ft$^2$) and/or from about 15 g/m$^2$ (9.2 lbs/3000 ft$^2$) to about 110 g/m$^2$ (67.7 lbs/3000 ft$^2$) and/or from about 20 g/m$^2$ (12.3 lbs/3000 ft$^2$) to about 100 g/m$^2$ (61.5 lbs/3000 ft$^2$) and/or from about 30 (18.5 lbs/3000 ft$^2$) to 90 g/m$^2$ (55.4 lbs/3000 ft$^2$). In addition, the sanitary tissue products and/or fibrous structures of the present invention may exhibit a basis weight between about 40 g/m$^2$ (24.6 lbs/3000 ft$^2$) to about 120 g/m$^2$ (73.8 lbs/3000 ft$^2$) and/or from about 50 g/m$^2$ (30.8 lbs/3000 ft$^2$) to about 110 g/m$^2$ (67.7 lbs/3000 ft$^2$) and/or from about 55 g/m$^2$ (33.8 lbs/3000 ft$^2$) to about 105 g/m$^2$ (64.6 lbs/3000 ft$^2$) and/or from about 60 (36.9 lbs/3000 ft$^2$) to 100 g/m$^2$ (61.5 lbs/3000 ft$^2$).

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in)

and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

In another example, the sanitary tissue products may be in the form of discrete sheets that are stacked within and dispensed from a container, such as a box.

The fibrous structures and/or sanitary tissue products of the present invention may comprises additives such as softening agents, temporary wet strength agents, permanent wet strength agents, bulk softening agents, lotion compositions, silicones, wetting agents, latexes, especially surface-pattern-applied latexes, dry strength agents such as carboxymethylcellulose and starch, and other types of additives suitable for inclusion in and/or on sanitary tissue products.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 ft$^2$ or g/m$^2$ (gsm) and is measured according to the Basis Weight Test Method described herein described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Surface pattern" with respect to a fibrous structure and/or sanitary tissue product in accordance with the present invention means herein a pattern that is present on at least one surface of the fibrous structure and/or sanitary tissue product. The surface pattern may be a textured surface pattern such that the surface of the fibrous structure and/or sanitary tissue product comprises protrusions and/or depressions as part of the surface pattern. For example, the surface pattern may comprise embossment line elements and/or wet textured line elements. The surface pattern may be a non-textured surface pattern such that the surface of the fibrous structure and/or sanitary tissue product does not comprise protrusions and/or depressions as part of the surface pattern. For example, the surface pattern may be printed on a surface of the fibrous structure and/or sanitary tissue product.

"Line element" as used herein means a discrete, portion of a fibrous structure being in the shape of a continuous line that has an aspect ratio of greater than 1.5:1 and/or greater than 1.75:1 and/or greater than 2:1 and/or greater than 5:1. In one example, the line embossment exhibits a length of at least 2 mm and/or at least 4 mm and/or at least 6 mm and/or at least 1 cm to about 30 cm and/or to about 27 cm and/or to about 20 cm and/or to about 15 cm and/or to about 10.16 cm and/or to about 8 cm and/or to about 6 cm and/or to about 4 cm. The line element may be of any suitable shape such as straight, bent, kinked, curled, curvilinear, serpentine, sinusoidal and mixtures thereof, wherein the line element exhibits a length of at least 2 mm and/or at least 4 mm and/or at least 6 mm and/or at least 1 cm to about 30 cm and/or to about 27 cm and/or to about 20 cm and/or to about 15 cm and/or to about 10.16 cm and/or to about 8 cm and/or to about 6 cm and/or to about 4 cm.

Different line elements may exhibit different common intensive properties. For example, different line elements may exhibit different densities and/or basis weights. In one example, a fibrous structure of the present invention comprises a first group of first line elements and a second group of second line elements. The first group of first line elements may exhibit the same densities, which are lower than the densities of second line elements in a second group.

In one example, the line element is a straight or substantially straight line element. In another example, the line element is a curvilinear line element, such as a sinusoidal line element. Unless otherwise stated, the line elements of the present invention are present on a surface of a fibrous structure. The length and/or width and/or height of the line element and/or line element forming component within a molding member, which results in a line element within a fibrous structure, is measured by the Dimensions of Line Element/Line Element Forming Component Test Method described herein.

In one example, the line element and/or line element forming component is continuous or substantially continuous within a fibrous structure, for example in one case one or more 11 cm×11 cm sheets of fibrous structure.

The line elements may exhibit different widths along their lengths, between two or more different line elements and/or the line elements may exhibit different lengths. Different line elements may exhibit different widths and/or lengths.

In one example, the surface pattern of the present invention comprises a plurality of parallel line elements. The plurality of parallel line elements may be a series of parallel line elements. In one example, the plurality of parallel line elements may comprise a plurality of parallel sinusoidal line elements.

"Embossed" as used herein with respect to a fibrous structure and/or sanitary tissue product means that a fibrous structure and/or sanitary tissue product has been subjected to a process which converts a smooth surfaced fibrous structure and/or sanitary tissue product to a decorative surface by replicating a design on one or more emboss rolls, which form a nip through which the fibrous structure and/or sanitary tissue product passes. Embossed does not include creping, microcreping, printing or other processes that may also impart a texture and/or decorative pattern to a fibrous structure and/or sanitary tissue product.

"Average distance" as used herein with reference to the average distance between two line elements is the average of the distances measured between the centers of two immediately adjacent line elements measured along their respective lengths. Obviously, if one of the line elements extends further than the other, the measurements would stop at the ends of the shorter line element.

In one example, the continuous lines of the present invention may comprise wet texture, such as being formed by wet molding and/or through-air-drying via a fabric and/or an imprinted through-air-drying fabric. In one example, the wet texture line elements are water-resistant.

"Water-resistant" as it refers to a surface pattern or part thereof means that a line element and/or pattern comprising the line element retains its structure and/or integrity after being saturated by water and the line element and/or pattern is still visible to a consumer. In one example, the line elements and/or pattern may be water-resistant.

"Discrete" as it refers to a line element means that a line element has at least one immediate adjacent region of the fibrous structure that is different from the line element. In one example, a plurality of parallel line elements are discrete and/or separated from adjacent parallel line elements by a channel. The channel may exhibit a complementary shape to the parallel line elements. In other words, if the plurality of parallel line elements are straight lines, then the channels separating the parallel line elements would be straight. Likewise, if the plurality of parallel line elements are sinusoidal lines, then the channels separating the parallel line elements would be sinusoidal. The channels may exhibit the same widths and/or lengths as the line elements.

"Substantially machine direction oriented" as it refers to a line element means that the total length of the line element that is positioned at an angle of greater than 45° to the cross machine direction is greater than the total length of the line element that is positioned at an angle of 45° or less to the cross machine direction.

"Substantially cross machine direction oriented" as it refers to a line element means that the total length of the line element that is positioned at an angle of 45° or greater to the machine direction is greater than the total length of the line element that is positioned at an angle of less than 45° to the machine direction.

"Wet textured" as used herein means that a fibrous structure comprises texture (for example a three-dimensional topography) imparted to the fibrous structure and/or fibrous structure's surface during a fibrous structure making process. In one example, in a wet-laid fibrous structure making process, wet texture can be imparted to a fibrous structure upon fibers and/or filaments being collected on a collection device that has a three-dimensional (3D) surface which imparts a 3D surface to the fibrous structure being formed thereon and/or being transferred to a fabric and/or belt, such as a through-air-drying fabric and/or a patterned drying belt, comprising a 3D surface that imparts a 3D surface to a fibrous structure being formed thereon. In one example, the collection device with a 3D surface comprises a patterned, such as a patterned formed by a polymer or resin being deposited onto a base substrate, such as a fabric, in a patterned configuration. The wet texture imparted to a wet-laid fibrous structure is formed in the fibrous structure prior to and/or during drying of the fibrous structure. Non-limiting examples of collection devices and/or fabric and/or belts suitable for imparting wet texture to a fibrous structure include those fabrics and/or belts used in fabric creping and/or belt creping processes, for example as disclosed in U.S. Pat. Nos. 7,820,008 and 7,789,995, coarse through-air-drying fabrics as used in uncreped through-air-drying processes, and photo-curable resin patterned through-air-drying belts, for example as disclosed in U.S. Pat. No. 4,637,859. For purposes of the present invention, the collection devices used for imparting wet texture to the fibrous structures would be patterned to result in the fibrous structures comprising a surface pattern comprising a plurality of parallel line elements wherein at least one, two, three, or more, for example all of the parallel line elements exhibit a non-constant width along the length of the parallel line elements. This is different from non-wet texture that is imparted to a fibrous structure after the fibrous structure has been dried, for example after the moisture level of the fibrous structure is less than 15% and/or less than 10% and/or less than 5%. An example of non-wet texture includes embossments imparted to a fibrous structure by embossing rolls during converting of the fibrous structure.

"Non-rolled" as used herein with respect to a fibrous structure and/or sanitary tissue product of the present invention means that the fibrous structure and/or sanitary tissue product is an individual sheet (for example not connected to adjacent sheets by perforation lines. However, two or more individual sheets may be interleaved with one another) that is not convolutedly wound about a core or itself. For example, a non-rolled product comprises a facial tissue.

Fibrous Structure

Figure 4:
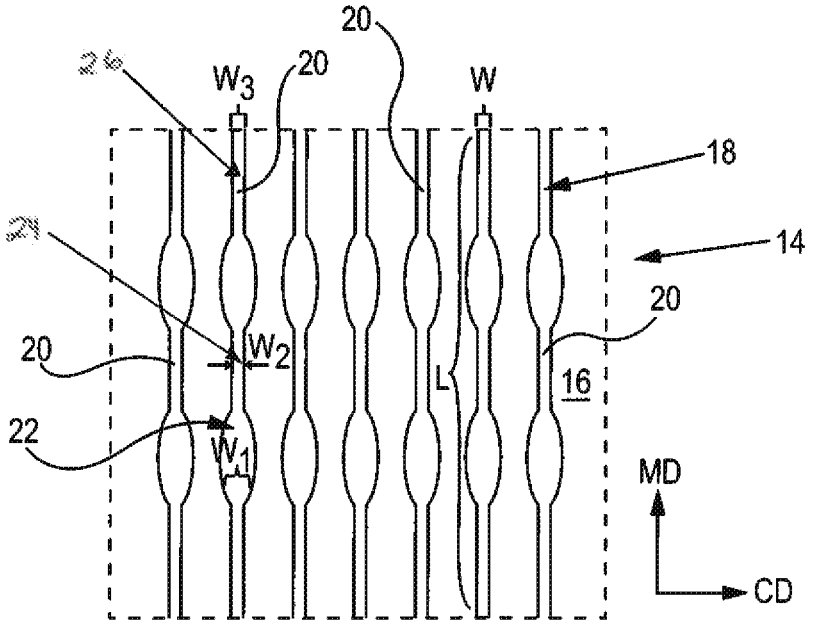
FIG. 4 is a top plan view of an example of a surface pattern of a fibrous structure according to the present invention.

As shown in FIG. 4, an example of a fibrous structure 14 of the present invention comprises a surface 16 exhibiting a machine direction and a cross machine direction. The surface 16 having a surface pattern 18 comprising a plurality of parallel line elements 20. As shown in FIG. 4, two or more, for example a plurality of parallel line elements 20 may form part of the surface pattern 18 on the fibrous structure 14.

As shown in FIG. 4, a line element 20 of the present invention exhibits a non-constant width W along its length L. In one example, the line element 20 may exhibit a first region 22 that exhibits a first minimum width $W_1$ and a second region 24 that exhibits a second minimum width $W_2$ that is different from the first minimum width $W_1$. In one example, the first minimum width $W_1$ is greater than the second minimum width $W_2$. In another example, the line element 20 of the present invention exhibits a third region 26 that exhibits a third minimum width $W_3$. The third minimum width $W_3$ may be the same or different from the first and second minimum widths $W_1$, $W_2$. In one example, the third minimum width $W_3$ is the same as the second minimum width $W_2$.

Figure 5:
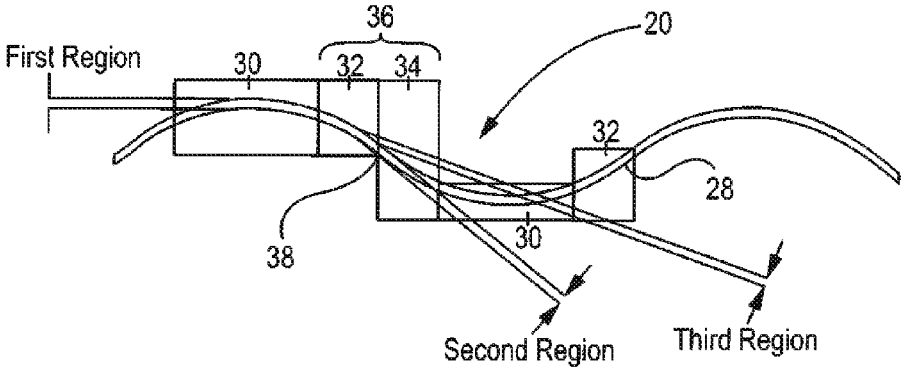
FIG. 5 is a schematic representation of a line element according to the present invention.

As shown in FIG. 5, a line element 20 of the present invention may be a sinusoidal line element 28. The sinusoidal line element 28 may exhibit a first region 30 that exhibits a first minimum width $W_1$ and a second region 32 that exhibits a second minimum width $W_2$ that is different from the first minimum width $W_1$. In one example, the first minimum width $W_1$ of the sinusoidal line element 28 is greater than the second minimum width $W_2$. In another example, the sinusoidal line element 28 of the present invention exhibits a third region 34 that exhibits a third minimum width $W_3$. The third minimum width $W_3$ of the sinusoidal line element 28 may be the same or different from the first and second minimum widths $W_1$, $W_2$. In one example, the third minimum width $W_3$ is the same as the second minimum width $W_2$.

In one example, the first region 30 of the sinusoidal line element 28 comprises a crest and/or a trough. In one example, the first region 30 of the sinusoidal line element 28 exhibits the same width throughout the length of the sinusoidal line element 28.

In addition to the crests and/or troughs, the second and third regions 32, 34 of the sinusoidal line elements 28 comprise a transition region 36 that connects a crest and an adjacent trough of the sinusoidal line element 28. In one example, the second and third regions 32, 34 meet at a transition point 38, which represents the minimum width $W_m$ of the transition region 36.

In one example, the first region 30, which is a crest of the sinusoidal line element 28 exhibits a constant width along its length, the second region 32 of the sinusoidal line element 28, which extends from the first region 30 (crest) exhibits a width that narrows along its length to the transition point 38, and the third region 34, which extends from the transition point 38 to the next first region 30 (trough), widens along its length from the transition point 38 to next first region 30 (trough).

Without wishing to be bound by theory, it is believed that the line element, especially the sinusoidal line element, that has a non-constant width along its length produces a torsion effect resulting in rotation of the surface pattern in which the line element, such as sinusoidal line element is present.

Figure 6:
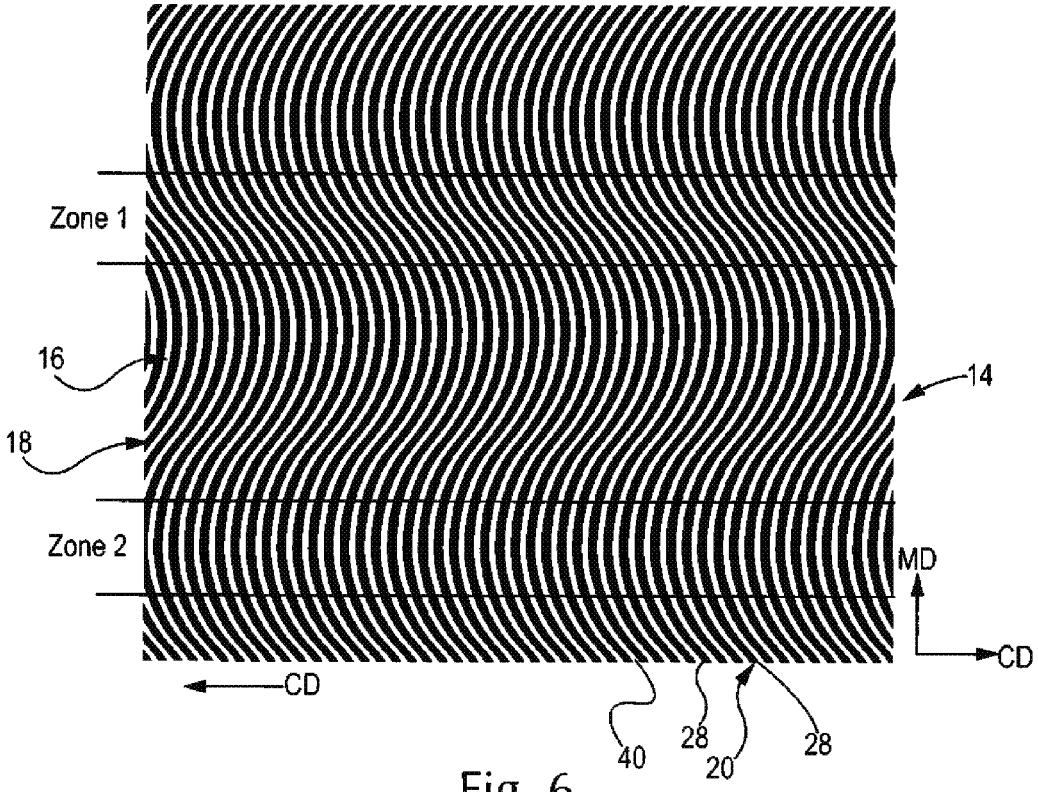
FIG. 6 is a top plan view of another example of a surface pattern of a fibrous structure according to the present invention.

FIG. 6 illustrates an example of a fibrous structure 14 of the present invention comprises a surface 16 exhibiting a machine direction and a cross machine direction. The surface 16 comprises a surface pattern 18 comprising a plurality of parallel line elements 20, which in this example comprise a plurality of parallel sinusoidal line elements 28. At least one of the plurality of parallel sinusoidal line elements 28 exhibits a non-constant width along its length.

Two or more or all of the parallel line elements 20, and thus two or more or all of the parallel sinusoidal line elements 28 are identical so that they are oriented to form a series of the same region of different parallel line elements 20, such as the parallel sinusoidal line elements 28. This is evident from FIG. 6 which illustrates that the crest and troughs and transition regions of the parallel sinusoidal line elements 28 form zones, in this case cross machine direction (CD) zones as represented by Zone 1 and Zone 2 in FIG. 6. In one example the zones alternate across at least a portion of the fibrous structure 14. In other words, a Zone 2 is positioned between two Zone 1s and a Zone 1 is positioned between two Zone 2s and a Zone 2 is positioned between two Zone 1s and so on across at least a portion of the fibrous structure 14.

As shown in FIGS. 5 and 6, in one example, Zone 1 comprises the second and third regions 32, 34 of a sinusoidal line element 28, which also happens to be the transition region 36, and exhibits the second minimum width $W_2$ and the third minimum width $W_3$, which may the same. Zone 2 comprises the first region 30 of a sinusoidal line element 28, which also happens to be either a crest or a trough of the sinusoidal line element 28, and exhibits the first minimum width $W_1$. The first minimum width $W_1$ is greater than the second minimum width $W_2$ and the third minimum width $W_3$.

In one example, Zone 1 exhibits an elevation that is different from Zone 2. In one example Zone 2 exhibits a greater elevation than Zone 1 as measured according to MikroCAD. In another example, Zone 2 exhibits a lesser elevation than Zone 1 as measured according to MikroCAD. In one fibrous structure, there may be two or more Zone 1 s and two or more Zone 2s. The Zone 1 s across at least a portion of the fibrous structure 14 may exhibit a substantially similar elevation whereas the Zone 2s may exhibit greater and lesser elevations compared to the Zone 1 elevations.

In addition to the elevation differences between Zone 1s and Zone 2s, the fibrous structures of the present invention may comprise zones, such as Zone 1 and Zone 2 that exhibit differences in their respective CD stress (tensile strength)/strain (elongation) slopes. For example, the difference between the greater of the Zone 1 and Zone 2 CD stress/strain slopes and the lesser of the Zone 1 and Zone 2 CD stress/strain slopes is greater than 1.1 and/or greater than 1.5 and/or greater than 2 and/or greater than 2.5 and/or greater than 3 and/or greater than 3.5 and/or greater than 4 and/or greater than 4.5 as measured according to the Tensile Strength and Elongation Test Method described herein.

In another example, the fibrous structures of the present invention may comprise different zones, such as Zone 1 and Zone 2 that exhibit differences in their respective CD stress (tensile strength)/strain (elongation) slopes that result in a ratio of the greater of the Zone 1 and Zone 2 CD stress/strain slopes and the lesser of the Zone 1 and Zone 2 CD stress/strain slopes of greater than 1.07 and/or greater than 1.09 and/or greater than 1 and/or greater than 1.2 and/or greater than 1.4 and/or greater than 4 and/or greater than 4.5 as measured according to the Tensile Strength and Elongation Test Method described herein.

In still another example of the present invention, the fibrous structures of the present invention may comprise different zones, such as Zone 1 and Zone 2 that exhibit differences in their respective CD Modulii. For example, the difference between the greater of the Zone 1 and Zone 2 CD Modulii and the lesser of the Zone 1 and Zone 2 CD Modulii is greater than 150 g/cm* % at 15 g/cm and/or greater than 200 g/cm* % at 15 g/cm and/or greater than 250 g/cm* % at 15 g/cm and/or greater than 300 g/cm* % at 15 g/cm and/or greater than 350 g/cm* % at 15 g/cm and/or greater than 400 g/cm* % at 15 g/cm and/or greater than 420 g/cm* % at 15 g/cm as measured according to the Tensile Strength and Elongation Test Method described herein.

In yet another example of the present invention, the fibrous structures of the present invention may comprise different zones, such as Zone 1 and Zone 2 that exhibit differences in their respective CD Modulii that result in a ratio of the greater of the Zone 1 and Zone 2 CD Modulii and the lesser of the Zone 1 and Zone 2 CD Modulii of greater than 1.15 and/or greater than 1.17 and/or greater than 1.20 and/or greater than 1.25 and/or greater than 1.30 and/or greater than 1.35 as measured according to the Tensile Strength and Elongation Test Method described herein.

Although the discussion regarding FIGS. 5 and 6 has been focused on the parallel line elements 20, such as the sinusoidal line elements 28, in one example as shown, there are channels 40 that separate the parallel line elements 20. The channels 40 and the parallel line elements 20, such as the sinusoidal line elements 28 may be reversed so that the channels 40 in FIG. 6 would represent the parallel line elements 20 and the parallel line elements 20 would represent the channels 40.

Figure 7:
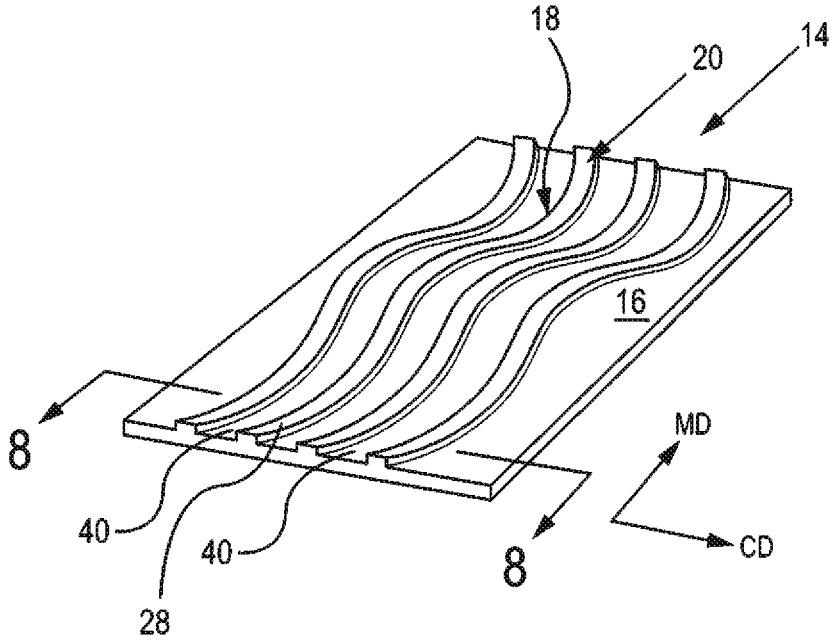
FIG. 7 is a perspective view of a fibrous structure comprising a schematic representation of the surface pattern of FIG. 6.
Figure 8:
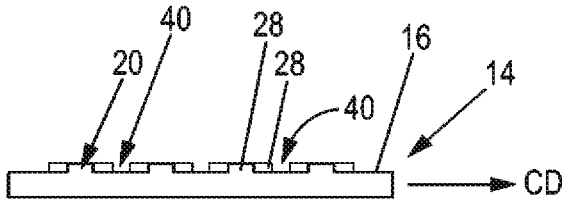
FIG. 8 is a cross-sectional view of FIG. 7 along line 8-8.

FIGS. 7 and 8 illustrate another example of a fibrous structure 14 according to the present invention. The fibrous structure 14 comprises a surface 16 exhibiting a machine direction and a cross machine direction. The surface 16 comprises a surface pattern 18 comprising a plurality of parallel line elements 20, which in this example comprise a plurality of parallel sinusoidal line elements 28. At least one of the plurality of parallel sinusoidal line elements 28 exhibits a non-constant width along its length.

In one example, one or more portions (sections) of a line element may exhibit a constant width so long as the line element as a whole exhibits a non-constant width.

In another example, one or more line elements and/or channels and/or portions (sections or regions) thereof of the present invention, which may complement one another as a result of the line elements being a plurality of parallel line elements, may exhibit minimum widths of greater than 0.01 inch and/or greater than 0.015 inch and/or greater than 0.02 inch and/or greater than 0.025 inch and/or greater than 0.03 inch and/or greater than 0.035 inch and/or greater than 0.04 inch and/or greater than 0.045 inch and/or greater than 0.05 inch and/or greater than 0.075 inch and/or to about 1 inch and/or to about 0.7 inch and/or to about 0.5 inch and/or to about 0.25 inch and/or to about 0.1 inch. Two or more of the parallel line elements may be separated from one another by a minimum width of greater than 0.01 inch and/or greater than 0.015 inch and/or greater than 0.02 inch and/or greater than 0.025 inch and/or greater than 0.03 inch and/or greater than 0.035 inch and/or greater than 0.04 inch and/or greater than 0.045 inch and/or greater than 0.05 inch and/or great the 0.075 inch and/or to about 1 inch and/or to about 0.7 inch and/or to about 0.5 inch and/or to about 0.25 inch and/or to about 0.1 inch.

The surface pattern may be an emboss pattern, imparted by passing a fibrous structure through an embossing nip comprising at least one patterned embossing roll patterned to impart a surface pattern according to the present invention, and/or a water-resistant pattern (i.e., wet textured pattern), such as a patterned through-air-drying belt that is patterned to impart a surface pattern according to the present invention, and/or a rush transfer or fabric creped or wet pressed imparted surface pattern or portions thereof, which imparts texture to the sanitary tissue product typically during the sanitary tissue product-making process.

Methods for Making Fibrous Structures/Sanitary Tissue Products

The fibrous structures and/or sanitary tissue products of the present invention may be made by any suitable process known in the art. The method may be a sanitary tissue product making process that uses a cylindrical dryer such as a Yankee (a Yankee-process) or it may be a Yankeeless process as is used to make substantially uniform density and/or uncreped fibrous structures and/or sanitary tissue products. Alternatively, the fibrous structures and/or sanitary tissue products may be made by an air-laid process and/or meltblown and/or spunbond processes and any combinations thereof so long as the fibrous structures and/or sanitary tissue products of the present invention are made thereby.

The fibrous structure and/or sanitary tissue product of the present invention may be made using a molding member. A "molding member" is a structural element that can be used as a support for an embryonic web comprising a plurality of cellulosic fibers and a plurality of synthetic fibers, as well as a forming unit to form, or "mold," a desired microscopical geometry of the sanitary tissue product of the present invention. The molding member may comprise any element that has fluid-permeable areas and the ability to impart a microscopical three-dimensional pattern to the fibrous structure being produced thereon, and includes, without limitation, single-layer and multi-layer structures comprising a stationary plate, a belt, a woven fabric (including Jacquard-type and the like woven patterns), a band, and a roll. In one example, the molding member is a deflection member. The molding member may comprise a surface pattern according to the present invention that is imparted to the fibrous structure and/or sanitary tissue product during the fibrous structure and/or sanitary tissue product making process.

A "reinforcing element" is a desirable (but not necessary) element in some embodiments of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

In one example of a method for making a fibrous structure and/or sanitary tissue product of the present invention, the method comprises the step of contacting an embryonic fibrous web with a deflection member (molding member) such that at least one portion of the embryonic fibrous web is deflected out-of-plane of another portion of the embryonic fibrous web. The phrase "out-of-plane" as used herein means that the fibrous structure and/or sanitary tissue product comprises a protuberance, such as a line element, or a cavity, such as a channel, that extends away from the plane of the fibrous structure and/or sanitary tissue product. The molding member may comprise a through-air-drying fabric having its filaments arranged to produce line elements within the fibrous structures and/or sanitary tissue products of the present invention and/or the through-air-drying fabric or equivalent may comprise a resinous framework that defines deflection conduits that allow portions of the fibrous structure and/or sanitary tissue product to deflect into the conduits thus forming line elements within the fibrous structures and/or sanitary tissue products of the present invention. In addition, a forming wire, such as a foraminous member may be arranged such that line elements within the fibrous structures and/or sanitary tissue products of the present invention are formed and/or like the through-air-drying fabric, the foraminous member may comprise a resinous framework that defines deflection conduits that allow portions of the sanitary tissue product to deflect into the conduits thus forming line elements within the fibrous structures and/or sanitary tissue products of the present invention.

In another example of a method for making a fibrous structure and/or sanitary tissue product of the present invention, the method comprises the steps of:

(a) providing a fibrous furnish comprising fibers;

(b) depositing the fibrous furnish onto a foraminous member to form an embryonic fibrous web;

(c) associating the embryonic fibrous web with a molding member comprising a surface pattern such that the surface pattern; and (d) drying said embryonic fibrous web such that that the surface pattern is imparted to the dried fibrous structure and/or sanitary tissue product to produce the fibrous structure and/or sanitary tissue product according to the present invention.

In another example of a method for making a fibrous structure and/or sanitary tissue product of the present invention, the method comprises the steps of:

(a) providing a fibrous structure; and (b) imparting a surface pattern to the fibrous structure to produce the sanitary tissue product according to the present invention.

In another example, the step of imparting a surface pattern to a fibrous structure and/or sanitary tissue product comprises contacting a molding member comprising a surface pattern with a fibrous structure and/or sanitary tissue product such that the surface pattern is imparted to the fibrous structure and/or sanitary tissue product to make a fibrous structure and/or sanitary tissue product according to the present invention. The molding member may be a patterned belt that comprises a surface pattern.

In another example, the step of imparting a surface pattern to a fibrous structure and/or sanitary tissue product comprises passing a fibrous structure and/or sanitary tissue product through an embossing nip formed by at least one embossing roll comprising a surface pattern such that the surface pattern is imparted to the fibrous structure and/or sanitary tissue product to make a fibrous structure and/or sanitary tissue product according to the present invention.

In still another example of the present invention, a method for making a fibrous structure according to the present invention comprises the steps of:

a. forming an embryonic fibrous structure (i.e., base web);

b. molding the embryonic fibrous structure using a molding member (i.e., papermaking belt) such that a fibrous structure according to the present invention is formed; and c. drying the fibrous structure.

Figure 9:
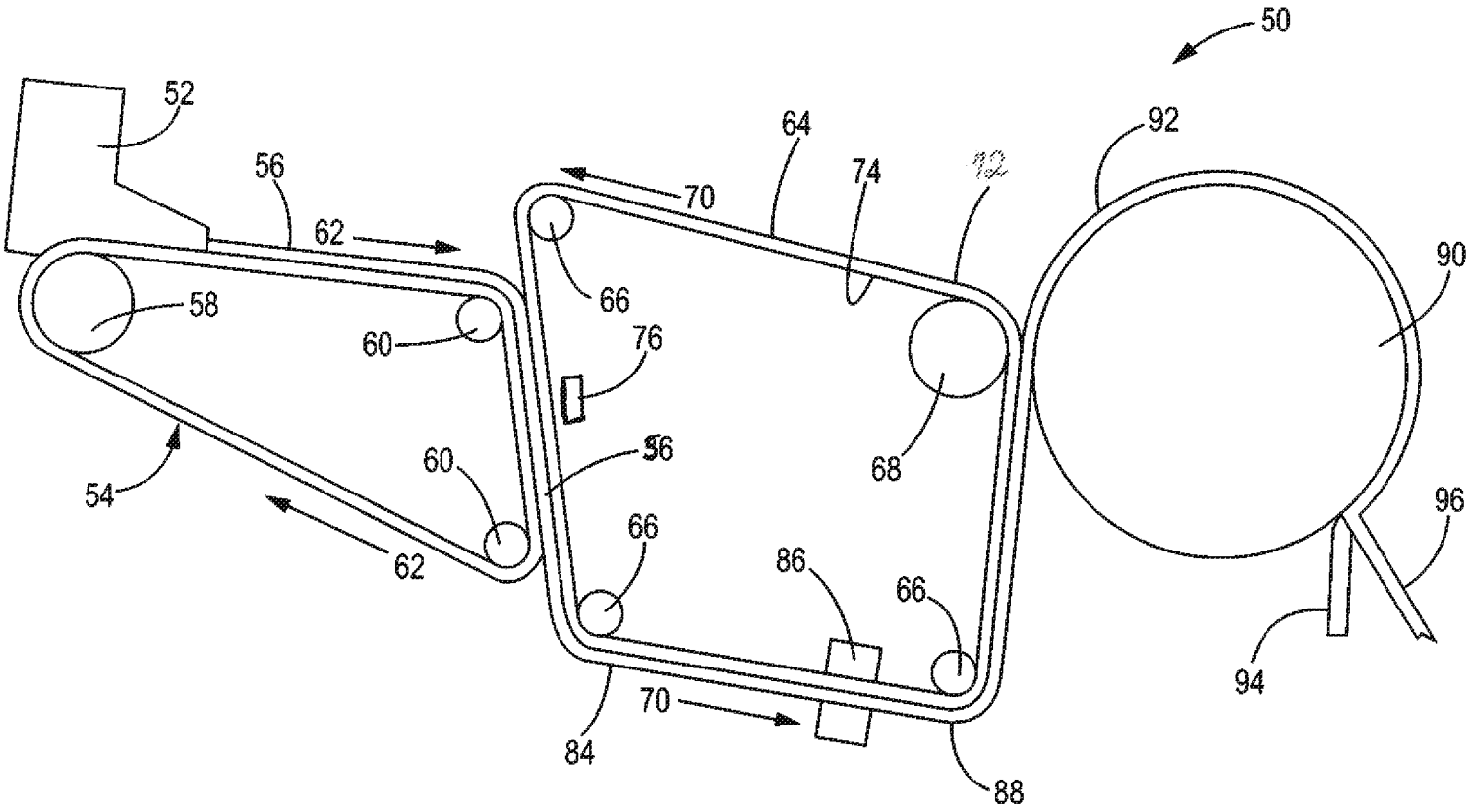
FIG. 9 is a schematic representation of an example of a process for making a fibrous structure according to the present invention.

FIG. 9 is a simplified, schematic representation of one example of a continuous fibrous structure making process and machine useful in the practice of the present invention.

As shown in FIG. 9, one example of a process and equipment, represented as 50 for making a fibrous structure according to the present invention comprises supplying an aqueous dispersion of fibers (a fibrous furnish) to a headbox 52 which can be of any convenient design. From headbox 52 the aqueous dispersion of fibers is delivered to a first foraminous member 54 which is typically a Fourdrinier wire, to produce an embryonic fibrous web 56.

The first foraminous member 54 may be supported by a breast roll 58 and a plurality of return rolls 60 of which only two are shown. The first foraminous member 54 can be propelled in the direction indicated by directional arrow 62 by a drive means, not shown. Optional auxiliary units and/or devices commonly associated fibrous structure making machines and with the first foraminous member 54, but not shown, include forming boards, hydrofoils, vacuum boxes, tension rolls, support rolls, wire cleaning showers, and the like.

After the aqueous dispersion of fibers is deposited onto the first foraminous member 54, embryonic fibrous web 56 is formed, typically by the removal of a portion of the aqueous dispersing medium by techniques well known to those skilled in the art. Vacuum boxes, forming boards, hydrofoils, and the like are useful in effecting water removal. The embryonic fibrous web 56 may travel with the first foraminous member 54 about return roll 60 and is brought into contact with a molding member, such as a deflection member 64, which may also be referred to as a second foraminous member. While in contact with the deflection member 64, the embryonic fibrous web 56 will be deflected, rearranged, and/or further dewatered.

The deflection member 64 may be in the form of an endless belt. In this simplified representation, deflection member 64 passes around and about deflection member return rolls 66 and impression nip roll 68 and may travel in the direction indicated by directional arrow 70. Associated with deflection member 64, but not shown, may be various support rolls, other return rolls, cleaning means, drive means, and the like well known to those skilled in the art that may be commonly used in fibrous structure making machines.

Regardless of the physical form which the deflection member 64 takes, whether it is an endless belt as just discussed or some other embodiment such as a stationary plate for use in making handsheets or a rotating drum for use with other types of continuous processes, it must have certain physical characteristics. For example, the deflection member may take a variety of configurations such as belts, drums, flat plates, and the like.

First, the deflection member 64 may be foraminous. That is to say, it may possess continuous passages connecting its first surface 72 (or "upper surface" or "working surface"; i.e. the surface with which the embryonic fibrous web is associated, sometimes referred to as the "embryonic fibrous web-contacting surface") with its second surface 74 (or "lower surface"; i.e., the surface with which the deflection member return rolls are associated). In other words, the deflection member 64 may be constructed in such a manner that when water is caused to be removed from the embryonic fibrous web 56, as by the application of differential fluid pressure, such as by a vacuum box 76, and when the water is removed from the embryonic fibrous web 56 in the direction of the deflection member 64, the water can be discharged from the system without having to again contact the embryonic fibrous web 56 in either the liquid or the vapor state.

Figure 10:
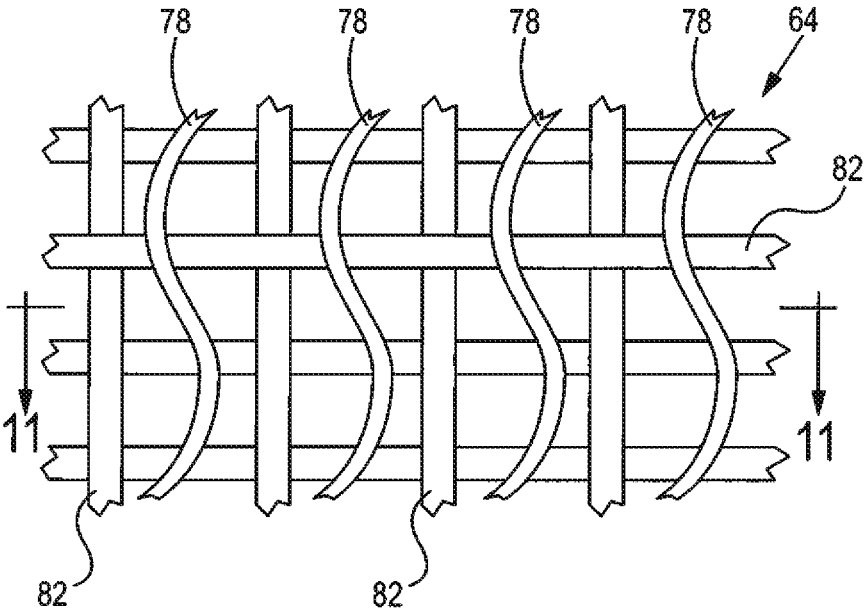
FIG. 10 is a schematic representation of an example of a molding member suitable for use in the process of the present invention.
Figure 11:
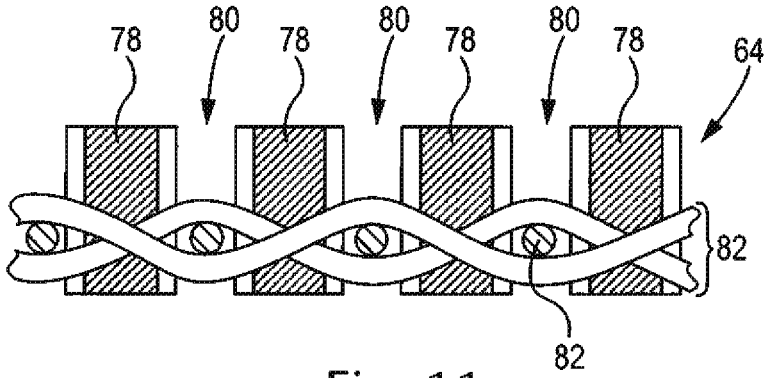
FIG. 11 is a cross-sectional view of FIG. 10 along line 11-11.

Second, the first surface 72 of the deflection member 64 may comprise one or more ridges 78 as represented in one example in FIGS. 10 and 11. The ridges 78 may be made by any suitable material. For example, a resin may be used to create the ridges 78. The ridges 78 may be continuous, or essentially continuous. In one example, the ridges 78 exhibit a length of greater than about 30 mm. The ridges 78 may be arranged to produce the fibrous structures of the present invention when utilized in a suitable fibrous structure making process. The ridges 78 may be patterned. The ridges 78 may be present on the deflection member 64 at any suitable frequency to produce the fibrous structures of the present invention. The ridges 78 may define within the deflection member 64 a plurality of deflection conduits 80. The deflection conduits 80 may be discrete, isolated, deflection conduits.

The deflection conduits 80 of the deflection member 64 may be of any size and shape or configuration so long at least one produces a linear element in the fibrous structure produced thereby. The deflection conduits 80 may repeat in a random pattern or in a uniform pattern. Portions of the deflection member 64 may comprise deflection conduits 80 that repeat in a random pattern and other portions of the deflection member 64 may comprise deflection conduits 80 that repeat in a uniform pattern.

The ridges 78 of the deflection member 64 may be associated with a belt, wire or other type of substrate. As shown in FIGS. 10 and 11, the ridges 78 of the deflection member 64 is associated with a woven belt 82. The woven belt 82 may be made by any suitable material, for example polyester, known to those skilled in the art.

As shown in FIG. 11, a cross sectional view of a portion of the deflection member 64 taken along line 11-11 of FIG. 10, the deflection member 64 can be foraminous since the deflection conduits 80 extend completely through the deflection member 64.

In one example, the deflection member of the present invention may be an endless belt which can be constructed by, among other methods, a method adapted from techniques used to make stencil screens. By "adapted" it is meant that the broad, overall techniques of making stencil screens are used, but improvements, refinements, and modifications as discussed below are used to make member having significantly greater thickness than the usual stencil screen.

Broadly, a foraminous member (such as a woven belt) is thoroughly coated with a liquid photosensitive polymeric resin to a preselected thickness. A mask or negative incorporating the pattern of the preselected ridges is juxtaposed the liquid photosensitive resin; the resin is then exposed to light of an appropriate wave length through the mask. This exposure to light causes curing of the resin in the exposed areas. Unexpected (and uncured) resin is removed from the system leaving behind the cured resin forming the ridges defining within it a plurality of deflection conduits.

In another example, the deflection member can be prepared using as the foraminous member, such as a woven belt, of width and length suitable for use on the chosen fibrous structure making machine. The ridges and the deflection conduits are formed on this woven belt in a series of sections of convenient dimensions in a batchwise manner, i.e. one section at a time. Details of this non-limiting example of a process for preparing the deflection member follow.

First, a planar forming table is supplied. This forming table is at least as wide as the width of the foraminous woven element and is of any convenient length. It is provided with means for securing a backing film smoothly and tightly to its surface. Suitable means include provision for the application of vacuum through the surface of the forming table, such as a plurality of closely spaced orifices and tensioning means.

A relatively thin, flexible polymeric (such as polypropylene) backing film is placed on the forming table and is secured thereto, as by the application of vacuum or the use of tension. The backing film serves to protect the surface of the forming table and to provide a smooth surface from which the cured photosensitive resins will, later, be readily released. This backing film will form no part of the completed deflection member.

Either the backing film is of a color which absorbs activating light or the backing film is at least semi-transparent and the surface of the forming table absorbs activating light.

A thin film of adhesive, such as 8091 Crown Spray Heavy Duty Adhesive made by Crown Industrial Products Co. of Hebron, Ill., is applied to the exposed surface of the backing film or, alternatively, to the knuckles of the woven belt. A section of the woven belt is then placed in contact with the backing film where it is held in place by the adhesive. The woven belt is under tension at the time it is adhered to the backing film.

Next, the woven belt is coated with liquid photosensitive resin. As used herein, "coated" means that the liquid photosensitive resin is applied to the woven belt where it is carefully worked and manipulated to insure that all the openings (interstices) in the woven belt are filled with resin and that all of the filaments comprising the woven belt are enclosed with the resin as completely as possible. Since the knuckles of the woven belt are in contact with the backing film, it will not be possible to completely encase the whole of each filament with photosensitive resin. Sufficient additional liquid photosensitive resin is applied to the woven belt to form a deflection member having a certain preselected thickness. The deflection member can be from about 0.35 mm (0.014 in.) to about 3.0 mm (0.150 in.) in overall thickness and the ridges can be spaced from about 0.10 mm (0.004 in.) to about 2.54 mm (0.100 in.) from the mean upper surface of the knuckles of the woven belt. Any technique well known to those skilled in the art can be used to control the thickness of the liquid photosensitive resin coating. For example, shims of the appropriate thickness can be provided on either side of the section of deflection member under construction; an excess quantity of liquid photosensitive resin can be applied to the woven belt between the shims; a straight edge resting on the shims and can then be drawn across the surface of the liquid photosensitive resin thereby removing excess material and forming a coating of a uniform thickness.

Suitable photosensitive resins can be readily selected from the many available commercially. They are typically materials, usually polymers, which cure or cross-link under the influence of activating radiation, usually ultraviolet (UV) light. References containing more information about liquid photosensitive resins include Green et al, "Photocross-linkable Resin Systems," J. Macro. Sci-Revs. Macro. Chem, C21 (2), 187-273 (1981-82); Boyer, "A Review of Ultraviolet Curing Technology," Tappi Paper Synthetics Conf. Proc., Sept. 25-27, 1978, pp 167-172; and Schmidle, "Ultraviolet Curable Flexible Coatings," J. of Coated Fabrics, 8, 10-20 (July, 1978). All the preceding three references are incorporated herein by reference. In one example, the ridges are made from the Merigraph series of resins made by Hercules Incorporated of Wilmington, Del.

Once the proper quantity (and thickness) of liquid photosensitive resin is coated on the woven belt, a cover film is optionally applied to the exposed surface of the resin. The cover film, which must be transparent to light of activating wave length, serves primarily to protect the mask from direct contact with the resin.

A mask (or negative) is placed directly on the optional cover film or on the surface of the resin. This mask is formed of any suitable material which can be used to shield or shade certain portions of the liquid photosensitive resin from light while allowing the light to reach other portions of the resin. The design or geometry preselected for the ridges is, of course, reproduced in this mask in regions which allow the transmission of light while the geometries preselected for the gross foramina are in regions which are opaque to light.

A rigid member such as a glass cover plate is placed atop the mask and serves to aid in maintaining the upper surface of the photosensitive liquid resin in a planar configuration.

The liquid photosensitive resin is then exposed to light of the appropriate wave length through the cover glass, the mask, and the cover film in such a manner as to initiate the curing of the liquid photosensitive resin in the exposed areas. It is important to note that when the described procedure is followed, resin which would normally be in a shadow cast by a filament, which is usually opaque to activating light, is cured. Curing this particular small mass of resin aids in making the bottom side of the deflection member planar and in isolating one deflection conduit from another.

After exposure, the cover plate, the mask, and the cover film are removed from the system. The resin is sufficiently cured in the exposed areas to allow the woven belt along with the resin to be stripped from the backing film.

Uncured resin is removed from the woven belt by any convenient means such as vacuum removal and aqueous washing.

A section of the deflection member is now essentially in final form. Depending upon the nature of the photosensitive resin and the nature and amount of the radiation previously supplied to it, the remaining, at least partially cured, photosensitive resin can be subjected to further radiation in a post curing operation as required.

The backing film is stripped from the forming table and the process is repeated with another section of the woven belt. Conveniently, the woven belt is divided off into sections of essentially equal and convenient lengths which are numbered serially along its length. Odd numbered sections are sequentially processed to form sections of the deflection member and then even numbered sections are sequentially processed until the entire belt possesses the characteristics required of the deflection member. The woven belt may be maintained under tension at all times.

In the method of construction just described, the knuckles of the woven belt actually form a portion of the bottom surface of the deflection member. The woven belt can be physically spaced from the bottom surface.

Multiple replications of the above described technique can be used to construct deflection members having the more complex geometries.

The deflection member of the present invention may be made or partially made according to U.S. Pat. No. 4,637,859, issued Jan. 20, 1987 to Trokhan.

As shown in FIG. 9, after the embryonic fibrous web 56 has been associated with the deflection member 64, fibers within the embryonic fibrous web 56 are deflected into the deflection conduits present in the deflection member 64. In one example of this process step, there is essentially no water removal from the embryonic fibrous web 56 through the deflection conduits after the embryonic fibrous web 56 has been associated with the deflection member 64 but prior to the deflecting of the fibers into the deflection conduits. Further water removal from the embryonic fibrous web 56 can occur during and/or after the time the fibers are being deflected into the deflection conduits. Water removal from the embryonic fibrous web 56 may continue until the consistency of the embryonic fibrous web 56 associated with deflection member 64 is increased to from about 25% to about 35%. Once this consistency of the embryonic fibrous web 56 is achieved, then the embryonic fibrous web 56 is referred to as an intermediate fibrous web 84. During the process of forming the embryonic fibrous web 56, sufficient water may be removed, such as by a noncompressive process, from the embryonic fibrous web 56 before it becomes associated with the deflection member 64 so that the consistency of the embryonic fibrous web 56 may be from about 10% to about 30%.

While applicants decline to be bound by any particular theory of operation, it appears that the deflection of the fibers in the embryonic web and water removal from the embryonic web begin essentially simultaneously. Embodiments can, however, be envisioned wherein deflection and water removal are sequential operations. Under the influence of the applied differential fluid pressure, for example, the fibers may be deflected into the deflection conduit with an attendant rearrangement of the fibers. Water removal may occur with a continued rearrangement of fibers. Deflection of the fibers, and of the embryonic fibrous web, may cause an apparent increase in surface area of the embryonic fibrous web. Further, the rearrangement of fibers may appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the deflection conduit while the opposite ends are restrained in the region of the ridges. Shorter fibers, on the other hand, can actually be transported from the region of the ridges into the deflection conduit (The fibers in the deflection conduits will also be rearranged relative to one another). Naturally, it is possible for both modes of rearrangement to occur simultaneously.

As noted, water removal occurs both during and after deflection; this water removal may result in a decrease in fiber mobility in the embryonic fibrous web. This decrease in fiber mobility may tend to fix and/or freeze the fibers in place after they have been deflected and rearranged. Of course, the drying of the web in a later step in the process of this invention serves to more firmly fix and/or freeze the fibers in position.

Any convenient means conventionally known in the papermaking art can be used to dry the intermediate fibrous web 84. Examples of such suitable drying process include subjecting the intermediate fibrous web 84 to conventional and/or flow-through dryers and/or Yankee dryers.

In one example of a drying process, the intermediate fibrous web 84 in association with the deflection member 64 passes around the deflection member return roll 66 and travels in the direction indicated by directional arrow 70. The intermediate fibrous web 84 may first pass through an optional predryer 86. This predryer 86 can be a conventional flow-through dryer (hot air dryer) well known to those skilled in the art. Optionally, the predryer 86 can be a so-called capillary dewatering apparatus. In such an apparatus, the intermediate fibrous web 84 passes over a sector of a cylinder having preferential-capillary-size pores through its cylindrical-shaped porous cover. Optionally, the predryer 86 can be a combination capillary dewatering apparatus and flow-through dryer. The quantity of water removed in the predryer 86 may be controlled so that a predried fibrous web 88 exiting the predryer 86 has a consistency of from about 30% to about 98%. The predried fibrous web 88, which may still be associated with deflection member 64, may pass around another deflection member return roll 66 and as it travels to an impression nip roll 68. As the predried fibrous web 88 passes through the nip formed between impression nip roll 68 and a surface of a Yankee dryer 90, the ridge pattern formed by the top surface 72 of deflection member 64 is impressed into the predried fibrous web 88 to form a linear element imprinted fibrous web 92. The imprinted fibrous web 92 can then be adhered to the surface of the Yankee dryer 90 where it can be dried to a consistency of at least about 95%.

The imprinted fibrous web 92 can then be foreshortened by creping the imprinted fibrous web 92 with a creping blade 94 to remove the imprinted fibrous web 92 from the surface of the Yankee dryer 90 resulting in the production of a creped fibrous structure 96 in accordance with the present invention. As used herein, foreshortening refers to the reduction in length of a dry (having a consistency of at least about 90% and/or at least about 95%) fibrous web which occurs when energy is applied to the dry fibrous web in such a way that the length of the fibrous web is reduced and the fibers in the fibrous web are rearranged with an accompanying disruption of fiber-fiber bonds. Foreshortening can be accomplished in any of several well-known ways. One common method of foreshortening is creping. The creped fibrous structure 96 may be subjected to post processing steps such as calendaring, tuft generating operations, and/or embossing and/or converting.

In addition to the Yankee fibrous structure making process/method, the fibrous structures of the present invention may be made using a Yankeeless fibrous structure making process/method. Such a process oftentimes utilizes transfer fabrics to permit rush transfer of the embryonic fibrous web prior to drying. The fibrous structures produced by such a Yankeeless fibrous structure making process oftentimes a substantially uniform density.

The molding member/deflection member of the present invention may be utilized to imprint linear elements into a fibrous structure during a through-air-drying operation.

However, such molding members/deflection members may also be utilized as forming members upon which a fiber slurry is deposited.

In one example, the linear elements of the present invention may be formed by a plurality of non-linear elements, such as embossments and/or protrusions and/or depressions formed by a molding member, that are arranged in a line having an overall length of greater than about 4.5 mm and/or greater than about 6 mm and/or greater than about 10 mm and/or greater than about 20 mm and/or greater than about 30 mm and/or greater than about 45 mm and/or greater than about 60 mm and/or greater than about 75 mm and/or greater than about 90 mm.

In addition to imprinting linear elements into fibrous structures during a fibrous structure making process/method, linear elements may be created in a fibrous structure during a converting operation of a fibrous structure. For example, linear elements may be imparted to a fibrous structure by embossing linear elements into a fibrous structure.

The embryonic fibrous structure can be made from various fibers and/or filaments and can be constructed in various ways. For instance, the embryonic fibrous structure can contain pulp fibers and/or staple fibers. Further, the embryonic fibrous structure can be formed and dried in a wet-laid process using a conventional process, conventional wet-press, through-air drying process, fabric-creping process, belt-creping process or the like.

In one example, the embryonic fibrous structure is formed by a wet-laid forming section and transferred to a patterned drying belt (molding member) with the aid of vacuum air. The embryonic fibrous structure takes on a mirrored-molding of the patterned belt to provide a fibrous structure according to the present invention. The transfer and molding of the embryonic fibrous structure may also be by vacuum air, compressed air, pressing, embossing, belt-nipped rush-drag or the like.

The fibrous structure of the present invention may comprise fibers and/or filaments. In one example, the fibrous structure comprises pulp fibers, for example, the fibrous structure may comprise greater than 50% and/or greater than 75% and/or greater than 90% and/or to about 100% by weight on a dry fiber basis of pulp fibers. In another example, the fibrous structure may comprise softwood pulp fibers, for example NSK pulp fibers.

The fibrous structure of the present invention may comprise strength agents, for example temporary wet strength agents, such as glyoxylated polyacrylamides, which are commercially available from Ashland Inc. under the tradename Hercobond, and/or permanent wet strength agents, an example of which is commercially available as Kymene® from Ashland Inc., and/or dry strength agents, such as carboxymethylcellulose ("CMC") and/or starch.

The fibrous structures of the present invention may be a single-ply or multi-ply fibrous structure and/or a single-ply or multi-ply sanitary tissue product.

In one example of the present invention, a fibrous structure comprises cellulosic pulp fibers. However, other naturally-occurring and/or non-naturally occurring fibers and/or filaments may be present in the fibrous structures of the present invention.

In one example of the present invention, a fibrous structure comprises a throughdried fibrous structure. The fibrous structure may be creped or uncreped. In one example, the fibrous structure is a wet-laid fibrous structure.

In another example of the present invention, a fibrous structure may comprise one or more embossments.

The fibrous structure may be incorporated into a single- or multi-ply sanitary tissue product. The sanitary tissue product may be in roll form where it is convolutedly wrapped about itself with or without the employment of a core. In one example, the sanitary tissue product may be in individual sheet form, such as a stack of discrete sheets, such as in a stack of individual facial tissue.

Table 1 below sets for the values for the various properties discussed above for a fibrous structure in accordance with the present invention (Invention A) and comparative example fibrous structures.

TABLE 1

Figure 2A:
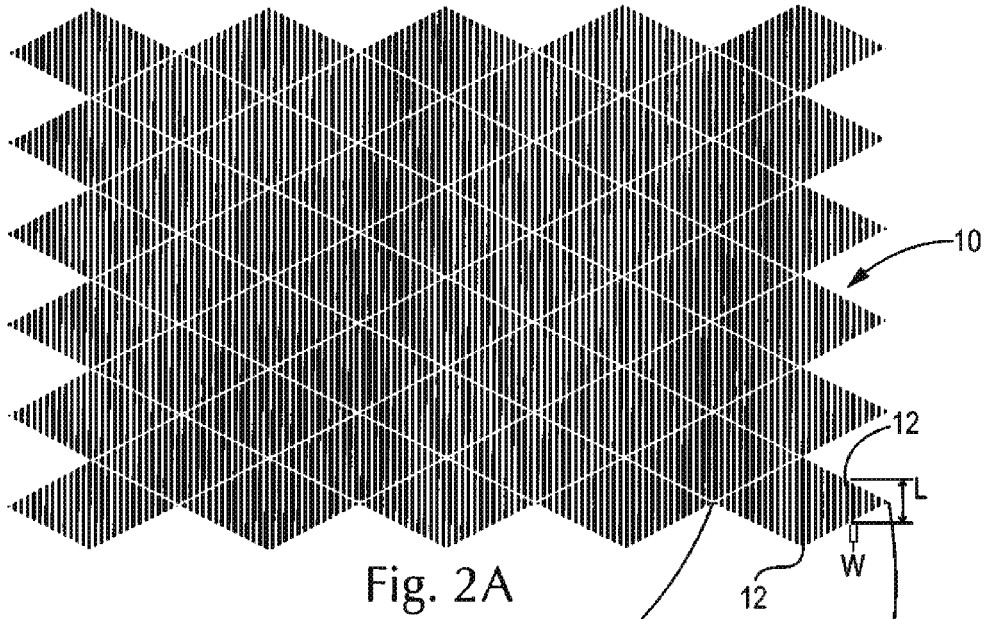
Fig. 2A PRIOR ART
FIG. 2A is a top plan view of another prior art surface pattern of a fibrous structure.
Figure 2B:
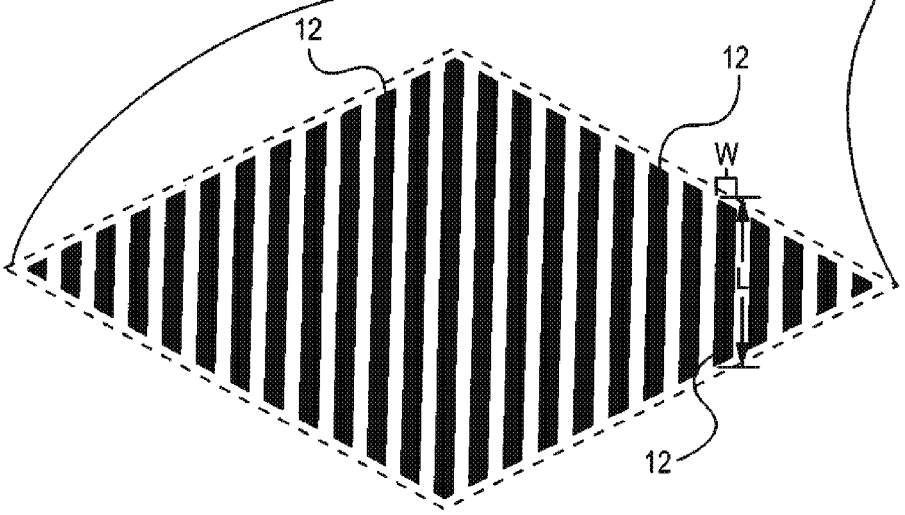
Fig. 2B PRIOR ART
FIG. 2B is a magnified top plan view of a portion of the prior art surface pattern of FIG. 2A.
Figure 3:
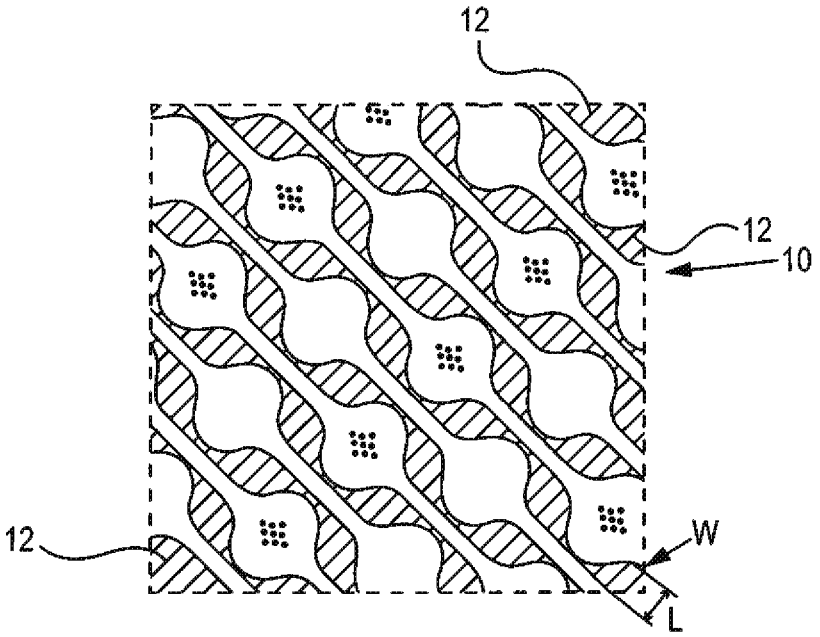
Fig. 3 PRIOR ART
FIG. 3 is a top plan view of even another prior art surface pattern of a fibrous structure.

| Design | Sample | Distance | Tensile, g/in | Elong | Modulus, g/cm* % @ 15 g/cm (calculated) | max. mod – min. mod (delta mod @15 g/cm (or 38.1 g/in)) | Ratio of Max Mod/ Min Mod | Max Slope | Min Slope | Ratio of Max Slope/ Min Slope |
|---|---|---|---|---|---|---|---|---|---|---|
| Invention A | Zone 2 | 0.026673 | 39.519 | 1.336 | 1164.6 | | | | | |
| | Zone 1 | 0.019913 | 40.297 | 0.997 | 1590.7 | | 1.366 | 34.125 | 29.7 | 1.15 |
| | | | | | | 426.1 | | | | |
| Comparative Example 1 | Zone 2 | 0.051733 | 39.422 | 1.286 | 1206.6 | | | | | |
| | Zone 1 | 0.04478 | 36.485 | 1.115 | 1287.9 | | 1.067 | 34.663 | 34.15 | 1.02 |
| | | | | | | 81.3 | | | | |
| Comparative Example 2 | Zone 2 | 0.05502 | 37.185 | 1.369 | 1069.6 | | | | | |
| | Zone 1 | 0.050107 | 38.177 | 1.248 | 1204.4 | | 1.126 | 23.904 | 22.85 | 1.05 |
| | | | | | | 134.8 | | | | |
| Comparative Example 3 | Zone 2 | 0.0588 | 37.457 | 1.463 | 1007.9 | | | | | |
| (Similar to FIG. 2A) | Zone 1 | 0.05376 | 37.049 | 1.339 | 1089.0 | | 1.080 | 29.537 | 28.47 | 1.04 |
| | | | | | | 81.1 | | | | |

Figure 12:
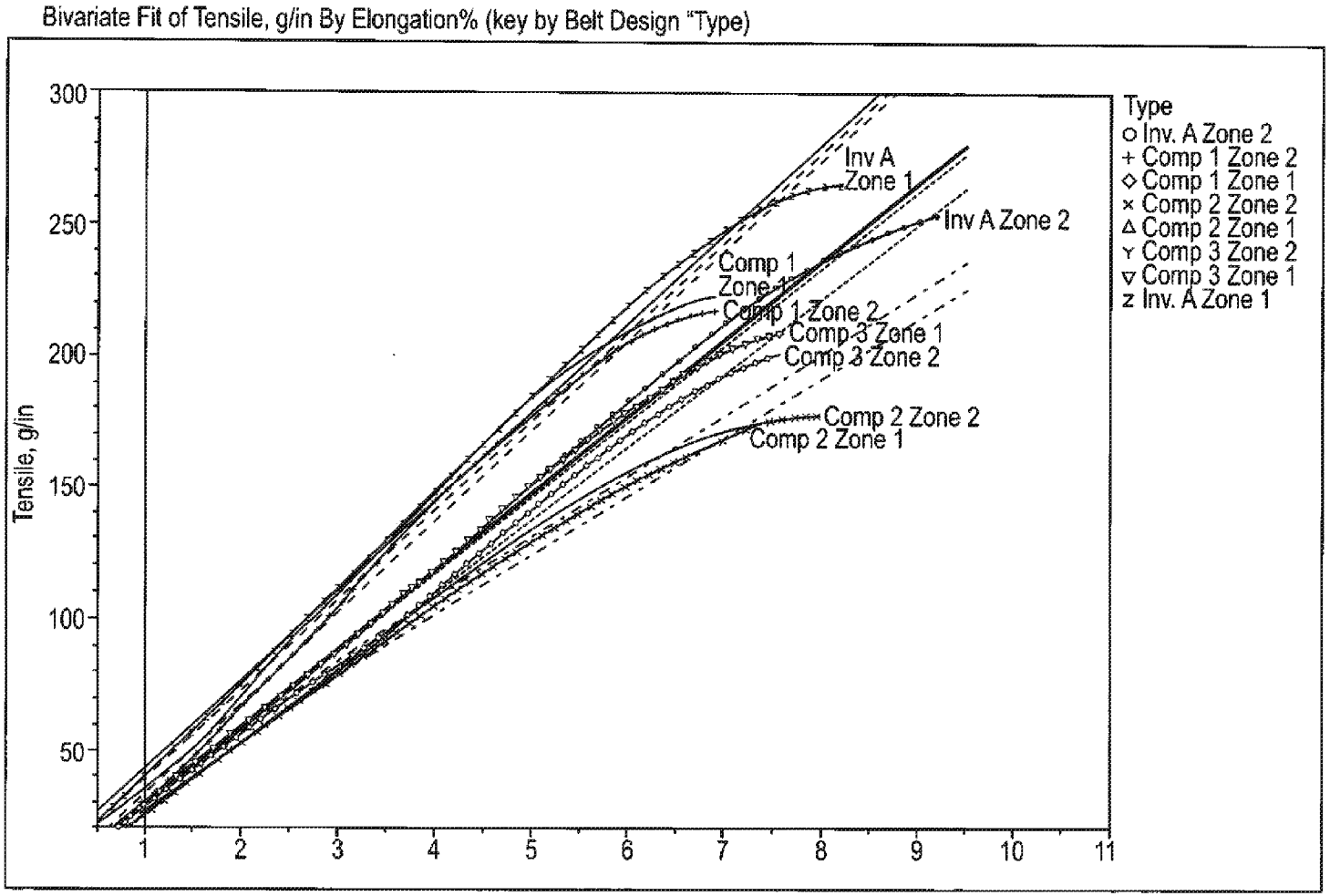
FIG. 12 is a graph of Tensile by Elongation showing a fibrous structure according to the present invention and comparative fibrous structures.
Figure 13:
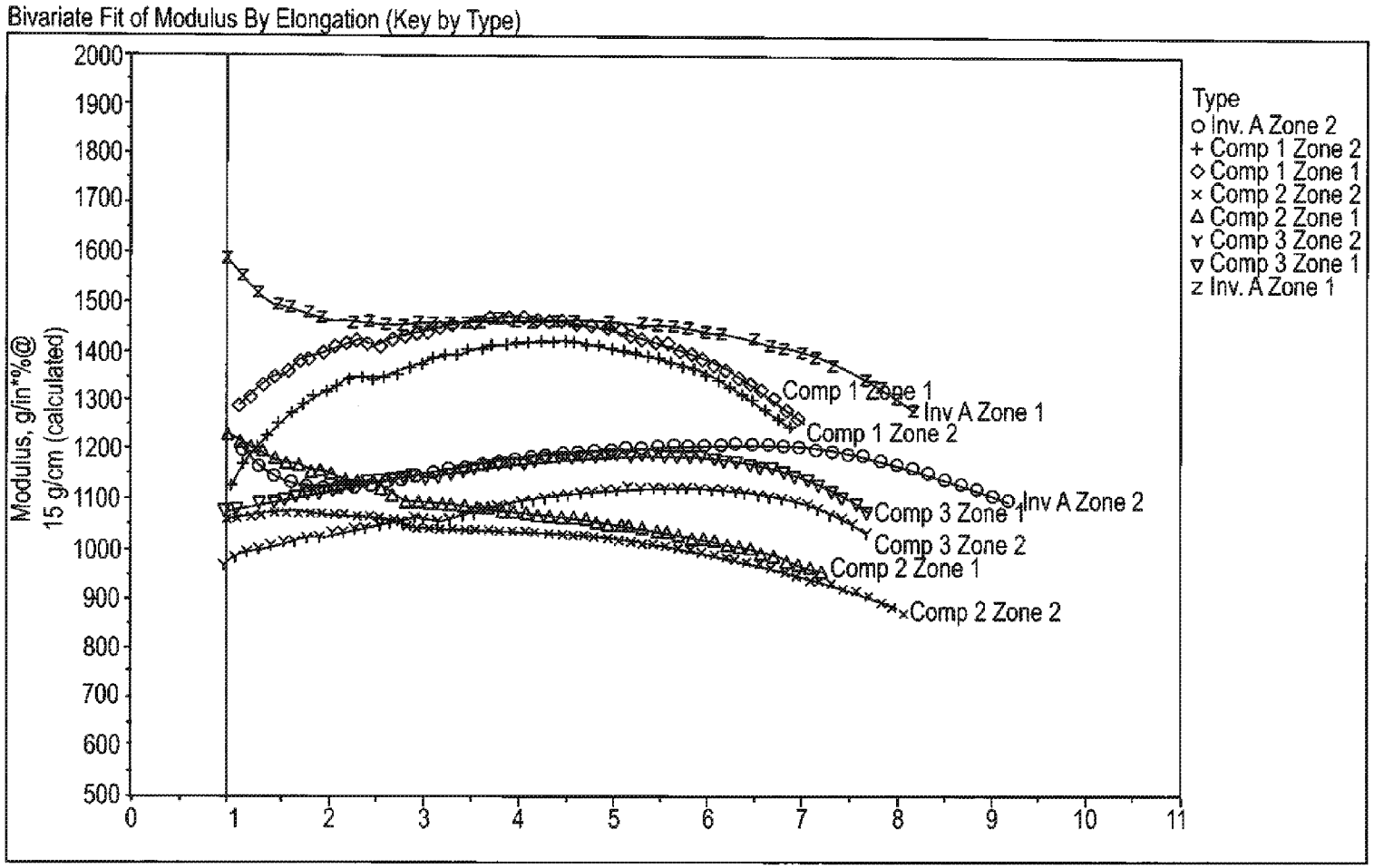
FIG. 13 is a graph of Modulus by Elongation showing a fibrous structure according to the present invention and comparative fibrous structures.

FIGS. 12 and 13 are graphs of the data from Table 1.

Non-Limiting Example

An example of a fibrous structure in accordance with the present invention may be prepared using a fibrous structure making machine having a layered headbox having a top middle and bottom chamber.

A hardwood stock chest is prepared with eucalyptus (Fibria Brazilian bleached hardwood kraft pulp) fiber having a consistency of about 3.0% by weight. A softwood stock chest is prepared with NSK (northern softwood Kraft) fibers having a consistency of about 3.0% by weight. The NSK fibers are refined to a Canadian Standard Freenesss (CSF) of about 540 to 545 ml.

A 2% solution of a permanent wet strength agent, for example Kymene® 1142, is added to the NSK stock pipe prior to refining at about 17.5 lbs. per ton of dry fiber. Kymene® 1142 is supplied by Hercules Corp of Wilmington, Del. A 1% solution of a dry strength agent, for example carboxy methyl cellulose (CMC), is added to the NSK slurry at a rate of about 2 lbs. per ton of dry fiber to enhance the dry strength of the fibrous structure. CMC is supplied by CP Kelco. The resulting aqueous slurry of NSK fibers passes through a centrifugal stock pump to aid in distributing the CMC.

The NSK slurry is diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as stratified layers until discharged onto a traveling Fourdrinier wire. A three layered headbox is used. The eucalyptus slurry, containing 75% of the dry weight of the tissue ply is directed to the middle and bottom chambers leading to the layer in contact with the wire, while the NSK slurry comprising of 25% of the dry weight of the ultimate tissue ply is directed to the chamber leading to the outside layer. The NSK and eucalyptus slurries are combined at the discharge of the headline into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is transferred from the Fourdrinier wire, at a fiber consistency of about 15% at the point of transfer, to a patterned drying fabric, for example a molding member, such as a patterned drying fabric, having the pattern shown in FIG. 6. The speed of the patterned drying fabric is the same as the speed of the Fourdrinier wire. The drying fabric is designed to yield a pattern of substantially machine direction oriented linear channels having a continuous network of high density areas resulting in a contact area (knuckle area) of about 49%. This drying fabric is formed by casting an impervious resin surface onto a fiber mesh supporting fabric. The supporting fabric is a 127×45 filament mesh. The thickness of the resin cast is about 7 mils above the supporting fabric.

Further de-watering is accomplished by vacuum assisted drainage until the web has a fiber consistency of about 25%. While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed a creping adhesive coating. The coating is a blend consisting of Vinylon Works' Vinylon 99-60 and Georgia Pacific's Unicrepe 457T20 Creping Aid. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. and a speed of about 800 fpm.

The dry web is passed through a rubber-on-steel calender gap (rubber on Yankee side of substrate). The dry web was calendered to a thickness of about 27 mils (4 plys combined together). The fibrous structure is wound in a roll using a surface driven reel drum having a surface speed of about 690 feet per minute.

Two plies are combined with the Yankee side facing out. During the converting process, a surface softening agent is applied with a slot extrusion die to the outside surface of both plies. The surface softening consists of a 19% by weight concentration of Wacker Silicone MR1003. At a converting speed of 400 feet per minute (fpm) approximately 2 grams/minute of softening agent is applied to each web to obtain a final add on of approximately 1444 parts per million. The plies are then bonded together with mechanical plybonding wheels, slit, and then folded into finished 2-ply facial tissue product. Each ply and the combined plies are tested in accordance with the test methods described supra.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

Basis Weight Test Method

Basis weight of a fibrous structure and/or sanitary tissue product sample is measured by selecting twelve (12) usable units of the fibrous structure and making two stacks of six (6) usable units each. If perforations or folds are present, keep them aligned on the same side when stacking the usable units. A precision cutter is used to cut each stack into exactly 3.500 in.×3.500 in. squares + or −0.0035 in tolerance in each dimension. The two stacks of cut squares are combined to make a basis weight stack of twelve (12) squares thick. The stack is then weighed on a top loading balance with a resolution of 0.001 g. The top loading balance must be protected from air drafts and other disturbances using a draft shield. Weights are recorded when the readings on the top loading balance become constant. The Basis Weight is calculated as follows:

$$\text{Basis Weight (lbs/3000 ft}^2) = \frac{\dfrac{\text{Weight of basis weight stack (g)}}{[453.6\ \text{g/lbs} \times 12\ \text{useable units}]}}{\left[\dfrac{12.25\ \text{in}^2\ \text{(which is the area of basis weight stack)}}{144\ \text{in}^2\text{ft}^2}\right] \times 3000}$$

$$\text{Basis Weight (g/m}^2) = \frac{\text{Weight of basis weight stack (g)} \times 10{,}000\ \text{cm}^2/\text{m}^2}{79.0321\ \text{cm}^2\ \text{(Area of basis weight stack)} \times 12\text{(usable units)}}$$

Report result to the nearest 0.1 (lbs/3000 $ft^2$ or $g/m^2$) Sample dimensions can be changed or varied using a similar precision cutter as mentioned above so long as at least 100 $in^2$ (accurate to +/−0.1 $in^2$) of sample area is measured and weighed on a top loading calibrated balance with a resolution of 0.001 g or smaller as described above.

Tensile Strength, Elongation, TEA and Modulus Test Methods

Four stacks of usable units are prepared using five samples in each stack. If the samples have a MD and CD to them, then samples in two stack are oriented in the same way with respect to MD and two stacks are oriented in the same way with respect to CD. (Fibrous structures which lack MD:CD orientation are used without this distinction.) The sample size needs to be sufficient for the tests described below. Two of the stacks are marked for testing in the MD and two for CD. A total of 8 strips are obtained by cutting 4 samples in the MD and 4 samples in the CD of dimensions 1.00" wide (2.54 cm) and at least 5" long.

A constant rate of extension tensile tester with computer interface ( ) (such as EJA Vantage from Thwing-Albert Instrument Co. of West Berlin, N.J.) equipped with pneumatic 1 inch wide flat face steel grips, supplied with 60+/−2 psi air pressure. The instrument is calibrated according to manufacturer's specifications. If slippage of a sample in the grips is observed, then increase the clamping pressure and run a new sample.

The crosshead speed is set to 4.00 in/min (10.16 cm/min). Gauge length set to 4.00 inches. Other instrument software parameters are set as follows: break sensitivity is set to 50% (i.e., test is completed when force drops to 50% of its maximum peak force), the sample width is set to 1.00 inch, and Pre-Tension force is set to 11.12 grams. The data acquisition rate is set to 20 points/second of both the force (g) and displacement (inches) data. The load cell on the instrument is first zeroed and the cross head position set to zero. A sample strip (1 inch wide by 1 usable unit thick) is first clamped in the upper grip of the tensile tester, followed by clamping the sample in the lower grip, with the long dimension of the sample strip running parallel to the sides of the tensile tester and centered within the grips. At least about 0.5 inches of sample must be clamped inside the upper and lower grips as measured from the front face of the grip. If more than 5 grams of force is observed just after both grips are closed, then the sample is too taught, and must be replaced with a new sample strip. The sample is too loose if, after 3 seconds following test initiation, less than 1 gram of force or less is recorded.

After the sample is loaded, the tensile program is initiated. The test is complete after the sample ruptures and the recorded tensile load falls to 50% of its peak value. When the test is complete, the following calculations are made on the acquired force (g) vs. displacement (inches) data, for both MD and CD tests.

The peak tensile strength is the maximum force recorded during the test, reported in force per unit of sample width, (g/in to the nearest 1 g/in). In order to calculate Peak Elongation, TEA, and Modulus, the acquired displacement data values are used to calculate strain values. The initial crosshead position is zero displacement position. The displacement distance data point at which the tensile force exceeds the Pre-Tension force (i.e, displacement distance just after 11.12 g) is termed the Pre-Tension Displacement (in). The Adjusted Gauge Length is defined as the sum of the Gauge Length (in this case 4.00 inches) and the Pre-Tension Displacement, and it also defines the zero strain point. Absolute strain values are calculated by dividing the acquired displacement values (in) by the Adjusted Gauge Length (in). Absolute strain can be converted to % Strain by multiplying by 100.

Peak Elongation is measured as the percent strain at the point of maximum force (units of %).

TEA is calculated by integrating the area under the tensile force (g) vs. displacement data (in) curve, from zero displacement up to peak force displacement, and dividing by the product of the Adjusted Gauge Length (in) and the sample width (1.00 in). TEA units are g*in/$in^2$ (which can be converted into g*cm/$cm^2$ as needed).

Modulus is defined here as the tangent slope from the force vs. strain data at 38.1 grams force. It is calculated by linear regression of 11 data acquisition points, centered at the first data point recorded just after the tensile force surpasses 190.5 g (38.1 g×5 layers), including next 5 points, as well as the previous 5 points (to make 11 total points). The slope of this linear regression results in the tangent slope with units of force divided by strain per unit sample width (2.54 cm), i.e., g/cm. (if there are not five points prior to 38.1 g increase the data rate)

Additional 3 samples are tested the same manner. The 4 MD sample results are averaged, and the 4 CD results are averaged, in terms of calculating Peak Load, Peak Elongation, TEA, and Modulus. Additional calculated terms are shown below.

Calculations:

Total Dry Tensile Strength (TDT)=Peak Load MD Tensile (g/in)+Peak Load CD Tensile (g/in)

Total_Modulus=MD Modulus (g/cm* % at 15 g/cm)+ CD Modulus (g/cm* % at 15 g/cm)

The stress(Tensile)/strain(Elongation) analysis for each of the samples was done with unconverted fibrous structures (not finished fibrous structures).

Orthogonal Regression Curves and Slopes:

The data used to generate the orthogonal slopes for each of the samples for include tensile and elongation beginning at 1% elongation and ending at peak load elongation.

Modulus Curves

Additionally, the curves depicting the modulus characteristic between the sample pairs utilized the same dataset mentioned above. Modulus for each stress/strain data point for each of samples was calculated as follows:

$$E=s/\epsilon$$

Where:

E=modulus s=tensile (stress)

$\epsilon$=elongation (strain)

Note: The above calculation is actually Young's Modulus which states:

$$E=\frac{\text{Tensile stress}}{\text{Tensile strain}}=\frac{s}{\epsilon}=\frac{F/A_0}{\Delta L/L_0}=\frac{FL_0}{A_0\Delta L}$$

Where:

E is the Young's modulus (modulus of elasticity)

F is the force exerted on an object under tension;

$A_0$ is the original cross-sectional area through which the force is applied;

$\Delta L$ is the amount by which the length of the object changes;

$L_0$ is the original length of the object.

Elevation Test Method

An elevation of a surface pattern or portion of a surface pattern on a fibrous structure and/or sanitary tissue product, for example an wet texture line element and/or embossment line element and/or portions of a surface pattern in a fibrous structure and/or sanitary tissue product can be measured using a GFM Mikrocad Optical Profiler instrument commercially available from GFMesstechnik GmbH, Warthestraβe 21, D14513 Teltow/Berlin, Germany. The GFM Mikrocad Optical Profiler instrument includes a compact optical measuring sensor based on the digital micro mirror projection, consisting of the following main components: a) DMD projector with 1024×768 direct digital controlled micro mirrors, b) CCD camera with high resolution (1300×1000 pixels), c) projection optics adapted to a measuring area of at least 44 mm×33 mm, and d) matching resolution recording optics; a table tripod based on a small hard stone plate; a cold light source; a measuring, control, and evaluation computer; measuring, control, and evaluation software ODSCAD 4.0, English version; and adjusting probes for lateral (x-y) and vertical (z) calibration.

The GFM Mikrocad Optical Profiler system measures the surface height of a fibrous structure and/or sanitary tissue product sample using the digital micro-mirror pattern projection technique. The result of the analysis is a map of surface height (z) vs. xy displacement. The system has a field of view of 140×105 mm with a resolution of 29 microns. The height resolution should be set to between 0.10 and 1.00 micron. The height range is 64,000 times the resolution.

The relative height of different portions of a surface pattern in a fibrous structure and/or sanitary tissue product can be visually determined via a topography image, which is obtained for each fibrous structure and/or sanitary tissue product sample as described below. At least three samples are measured. Actual height values can be obtained as follows below.

To measure the height or elevation of a surface pattern or portion of a surface pattern on a surface of a sanitary tissue product, the following can be performed: (1) Turn on the cold light source. The settings on the cold light source should be 4 and C, which should give a reading of 3000K on the display; (2) Turn on the computer, monitor and printer and open the ODSCAD 4.0 or higher Mikrocad Software; (3) Select "Measurement" icon from the Mikrocad taskbar and then click the "Live Pic" button; (4) Place a sanitary tissue product sample, of at least 5 cm by 5 cm in size, under the projection head, without any mechanical clamping, and adjust the distance for best focus; (5) Click the "Pattern" button repeatedly to project one of several focusing patterns to aid in achieving the best focus (the software cross hair should align with the projected cross hair when optimal focus is achieved). Position the projection head to be normal to the sanitary tissue product sample surface; (6) Adjust image brightness by changing the aperture on the camera lens and/or altering the camera "gain" setting on the screen. Set the gain to the lowest practical level while maintaining optimum brightness so as to limit the amount of electronic noise. When the illumination is optimum, the red circle at bottom of the screen labeled "I.O." will turn green; (7) Select Standard measurement type; (8) Click on the "Measure" button. This will freeze the live image on the screen and, simultaneously, the surface capture process will begin. It is important to keep the sample still during this time to avoid blurring of the captured images. The full digitized surface data set will be captured in approximately 20 seconds; (9) Save the data to a computer file with ".omc" extension. This will also save the camera image file ".kam"; (10) Export the file to the FD3 v1.0 format; 11) Measure and record at least three areas from each sample; 12) Import each file into the software package SPIP (Image Metrology, A/S, Hrsholm, Denmark); 13) Using the Averaging profile tool, draw a profile line perpendicular to height or elevation (such as embossment) transition region. Expand the averaging box to include as much of the height or elevation (embossment) as practical so as to generate an average profile of the transition region (from top surface to the bottom of the surface pattern or portion of surface pattern (such as an embossment) and backup to the top surface.). In the average line profile window, select a pair of cursor points.

To move the surface data into the analysis portion of the software, click on the clipboard/man icon; (11) Now, click on the icon "Draw Lines". Draw a line through the center of a region of features defining the texture of interest. Click on Show Sectional Line icon. In the sectional plot, click on any two points of interest, for example, a peak and the baseline, then click on vertical distance tool to measure height in microns or click on adjacent peaks and use the horizontal distance tool to determine in-plane direction spacing; and (12) for height measurements, use 3 lines, with at least 5 measurements per line, discarding the high and low values for each line, and determining the mean of the remaining 9 values. Also record the standard deviation, maximum, and minimum. For x and/or y direction measurements, determine the mean of 7 measurements. Also record the standard deviation, maximum, and minimum. Criteria that can be used to characterize and distinguish texture include, but are not limited to, occluded area (i.e. area of features), open area (area absent of features), spacing, in-plane size, and height. If the probability that the difference between the two means of texture characterization is caused by chance is less than 10%, the textures can be considered to differ from one another.

Dimensions of Line Element/Line Element Forming Component Test Method

The length of a line element in a fibrous structure and/or the length of a line element forming component in a molding member is measured by image scaling of a light microscopy image of a sample of fibrous structure.

A light microscopy image of a sample to be analyzed such as a fibrous structure or a molding member is obtained with a representative scale associated with the image. The images is saved as a *.tiff file on a computer. Once the image is saved, SmartSketch, version 05.00.35.14 software made by Intergraph Corporation of Huntsville, Ala, is opened. Once the software is opened and running on the computer, the user clicks on "New" from the "File" drop-down panel. Next, "Normal" is selected. "Properties" is then selected from the "File" drop-down panel. Under the "Units" tab, "mm" (millimeters) is chosen as the unit of measure and "0.123" as the precision of the measurement. Next, "Dimension" is selected from the "Format" drop-down panel. Click the "Units" tab and ensure that the "Units" and "Unit Labels" read "mm" and that the "Round-Off" is set at "0.123." Next, the "rectangle" shape from the selection panel is selected and dragged into the sheet area. Highlight the top horizontal line of the rectangle and set the length to the corresponding scale indicated light microscopy image. This will set the width of the rectangle to the scale required for sizing the light microscopy image. Now that the rectangle has been sized for the light microscopy image, highlight the top horizontal line and delete the line. Highlight the left and right vertical lines and the bottom horizontal line and select "Group". This keeps each of the line segments grouped at the width dimension ("mm") selected earlier. With the group highlighted, drop the "line width" panel down and type in "0.01 mm." The scaled line segment group is now ready to use for scaling the light microscopy image can be confirmed by right-clicking on the "dimension between", then clicking on the two vertical line segments.

To insert the light microscopy image, click on the "Image" from the "insert" drop-down panel. The image type is preferably a *.tiff format. Select the light microscopy image to be inserted from the saved file, then click on the sheet to place the light microscopy image. Click on the right bottom corner of the image and drag the corner diagonally from bottom-right to top-left. This will ensure that the image's aspect ratio will not be modified. Using the "Zoom In" feature, click on the image until the light microscopy image scale and the scale group line segments can be seen. Move the scale group segment over the light microscopy image scale. Increase or decrease the light microscopy image size as needed until the light microscopy image scale and the scale group line segments are equal. Once the light microscopy image scale and the scale group line segments are visible, the object(s) depicted in the light microscopy image can be measured using "line symbols" (located in the selection panel on the right) positioned in a parallel fashion and the "Distance Between" feature. For length and width measurements, a top view of a fibrous structure and/or molding member is used as the light microscopy image. For a height measurement, a side or cross sectional view of the fibrous structure and/or molding member is used as the light microscopy image.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising a surface comprising a surface pattern, wherein the surface pattern comprises a plurality of parallel line elements, wherein at least one parallel line element exhibits a non-constant width along its length, wherein the plurality of parallel line elements are arranged in the surface pattern such that a first zone comprising a series of a first portion of the parallel line elements having the same width is formed and a second zone comprising a series of a second portion of the parallel line elements having the same width different from the width of the first portion of the parallel line elements is formed such that the first and second zones differ in one or more of the following properties: CD stress/strain slopes, CD modulii, and combinations thereof.

2. The fibrous structure according to claim 1 wherein all of the plurality of parallel line elements exhibit a non-constant width along their lengths.

3. The fibrous structure according to claim 1 wherein two or more of the parallel line elements exhibit identical widths along their lengths.

4. The fibrous structure according to claim 1 wherein the surface pattern comprises a series of parallel line elements.

5. The fibrous structure according to claim 1 wherein two or more of the parallel line elements are wet textured.

6. The fibrous structure according to claim 1 wherein two or more of the parallel line elements comprise line element embossments.

7. The fibrous structure according to claim 1 wherein the plurality of parallel line elements comprise a plurality of parallel sinusoidal line elements.

8. The fibrous structure according to claim 7 wherein at least one parallel sinusoidal line element comprises a crest that differs in width than an adjacent transition portion of the sinusoidal line.

9. The fibrous structure according to claim 8 wherein the crest exhibits a constant width along the crest's length.

10. The fibrous structure according to claim 7 wherein at least one parallel sinusoidal line element comprises a trough that differs in width than an adjacent transition portion of the sinusoidal line.

11. The fibrous structure according to claim 10 wherein the trough exhibits a constant width along the trough's length.

12. The fibrous structure according to claim 7 wherein at least one parallel sinusoidal line element comprises a transition portion between an adjacent crest and trough that exhibits a non-constant width along the transition portion's length.

13. The fibrous structure according to claim 7 wherein the at least one parallel sinusoidal line element comprises a crest and a trough that exhibit the same width.

14. The fibrous structure according to claim 7 wherein the plurality of parallel sinusoidal line elements are identical so that they are oriented to form a series of the same region of different parallel line elements.

15. The fibrous structure according to claim 1 wherein the plurality of parallel line elements are substantially oriented in the fibrous structure's machine direction.

16. The fibrous structure according to claim 15 wherein the surface pattern is oriented at an angle of from about 20° to about 70° with respect to the fibrous structure's machine direction.

17. The fibrous structure according to claim 15 wherein the surface pattern is oriented at an angle of from about −10° to about 10° with respect to the fibrous structure's machine direction.

18. The fibrous structure according to claim 17 wherein the first zone exhibits a first CD stress/strain slope and the second zone exhibits a second CD stress/strain slope such that the difference between the greater of the first and second CD stress/strain slopes and the lesser of the first and second CD stress/strain slopes is greater than 1.1 as measured according to the Tensile Strength and Elongation Test Method described herein.

19. A sanitary tissue product comprising a fibrous structure according to claim 1.

20. A fibrous structure comprising a first zone and a second zone, wherein the first zone exhibits a first CD stress/strain slope and the second zone exhibits a second CD stress/strain slope such that the difference between the greater of the first and second CD stress/strain slopes and the lesser of the first and second CD stress/strain slopes is greater than 1.1 as measured according to the Tensile Strength and Elongation Test Method described herein.

* * * * *